US006989194B2

(12) United States Patent
Bansal et al.

(10) Patent No.: US 6,989,194 B2
(45) Date of Patent: Jan. 24, 2006

(54) FLAME RETARDANT FABRIC

(75) Inventors: Vishal Bansal, Richmond, VA (US); Hyun Sung Lim, Midlothian, VA (US); Harry Vaughn Samuelson, Chadds Ford, PA (US); Michael Robert Samuels, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/737,472

(22) Filed: Dec. 16, 2003

(65) Prior Publication Data

US 2004/0253441 A1 Dec. 16, 2004

Related U.S. Application Data

(60) Provisional application No. 60/437,105, filed on Dec. 30, 2002.

(51) Int. Cl.
*D02G 3/00* (2006.01)
*D03D 15/00* (2006.01)

(52) U.S. Cl. ..... 428/373; 428/374; 442/199; 442/311; 442/361

(58) Field of Classification Search ..... 428/373, 428/374, 375; 442/199, 311, 361

See application file for complete search history.

(56) References Cited

U.S. PATENT DOCUMENTS

| | | | | |
|---|---|---|---|---|
| 4,758,649 | A * | 7/1988 | Asano et al. | 528/73 |
| 5,049,295 | A * | 9/1991 | Takemura et al. | 252/62.54 |
| 5,525,700 | A * | 6/1996 | Samuels et al. | 528/190 |
| 5,976,998 | A * | 11/1999 | Sandor et al. | 442/365 |
| 6,207,273 | B1 * | 3/2001 | Kurihara et al. | 428/364 |
| 6,756,329 | B1 * | 6/2004 | Umino et al. | 442/181 |
| 6,774,203 | B1 * | 8/2004 | Fukute | 528/176 |
| 6,884,321 | B2 * | 4/2005 | Erb et al. | 162/145 |
| 2002/0124544 | A1 * | 9/2002 | Land et al. | 57/5 |
| 2004/0121088 | A1 * | 6/2004 | Bloom | 428/1.33 |
| 2004/0124405 | A1 * | 7/2004 | Sethumadhavan et al. | 257/1 |

FOREIGN PATENT DOCUMENTS

| | | |
|---|---|---|
| EP | 0 386 975 A2 | 9/1990 |
| EP | 1 116 739 A2 | 7/2001 |

OTHER PUBLICATIONS

"Kermel" Product Data Sheet, undated.*

Linda Sawyer, Jim Shepherd, Anne Kaslusky, Robert Knudsen, Unfilled Liquid Crystal Polymers, Tech Spotlight Advanced Materials & P.rocesses, Jun. 1, 2001, pp. 1-6, Ticona, Summit, NJ.

* cited by examiner

*Primary Examiner*—Jill M. Gray

(57) ABSTRACT

A flame retardant fabric comprising bicomponent fibers having a sheath and a core wherein the sheath comprises a fully aromatic thermoplastic polymer with a Limited Oxygen Index of at least 26 and the core comprises a thermoplastic polymer.

16 Claims, No Drawings

FLAME RETARDANT FABRIC

The present invention relates to fibers and fabrics made therefrom that provide flame retardant properties which are suitable for use in woven and nonwoven products including upholstery, bedding and garments.

Flame resistant fabrics are useful in preventing, slowing or stopping fires. For this reason they are particularly useful in upholstery, bedding and garments.

Fabrics made from fibers containing thermoplastic polymers such as polyester and polyamide can burn under certain conditions. To minimize this hazard, flame resistant compounds are copolymerized with the thermoplastic polymer, blended into the thermoplastic polymer or coated onto the surface of the fiber or fabric. The copolymerized and blended thermoplastic polymers require the flame retardant compound to occupy much or all of the fiber. This adds increased cost to the fabric. Flame resistant coatings on the fiber or fabric could lose some effectiveness because of wearing.

What is needed is a cost effective, durable, flame retardant fabric.

SUMMARY OF THE INVENTION

A flame retardant fabric comprising bicomponent fibers having a sheath and a core wherein the sheath comprises a fully aromatic thermoplastic polymer with a Limited Oxygen Index of at least 26 and the core comprises a thermoplastic polymer.

A flame retardant bicomponent fiber comprising a core of thermoplastic polymer and a sheath of a fully aromatic liquid crystalline polymer having a melting point (Tm) as measured by differential scanning calorimetry.

BRIEF DESCRIPTION OF THE INVENTION

The flame retardant fabric of this invention is made from bicomponent fibers having a sheath and a core wherein the sheath comprises a fully aromatic thermoplastic polymer with a Limited Oxygen Index (LOI) of at least 26 and the core comprises a thermoplastic polymer.

Fully aromatic thermoplastic polymers which resist flame propagation are those which consist essentially of repeating units of unsaturated cyclic hydrocarbons containing one or more rings connected with ester, amide or ether linkages. Examples of these types of polymers include, but are not limited to, fully aromatic: polyester polymers, polyesteramide polymers, polyamide-imide polymers, liquid crystalline polymers (LCP) and liquid crystalline polyester polymers. A preferred example is a fully aromatic liquid crystalline polymer having a melting point as measured by differential scanning calorimetry and, more preferably, a melting point between about 200° C. and about 325° C. Particularly advantageous flame retardant polymers useful for forming fibers and fabrics are low melting point (Tm) LCP's, such as those described in U.S. Pat. No. 5,525,700 which is hereby incorporated by reference. Such polymers do not contain alkyl groups and, without wishing to be bound by theory, it is believed that, whereas a fully aromatic thermoplastic polymer is flame retardant, the presence of alkyl groups could lead to flame propagation. Although a fully aromatic thermoplastic polymer is preferred, it is expected that minor amounts of alkyl groups in the polymer will not reduce the flame retardant efficacy of the polymer substantially.

For best efficacy, the fully aromatic thermoplastic polymer should at least cover the surface of the fiber. When exposed to flame, it is believed that the fully aromatic thermoplastic polymer first evolves carbon dioxide and subsequently forms a char that surrounds and protects the core from flame propagation, and in some cases actually acts to quench the flame. By limiting the flame retardant material to the sheath and not the entire fiber, the cost of manufacture is reduced.

A measure of the flame retardant capability can be determined from the limited oxygen index (LOI) of the fiber sheath polymer. The greater the LOI value, the greater the flame retardant propensity of the material. An LOI of at least about 26 would be preferred for a fabric to be flame retardant. An LOI of at least about 28 would be more preferred for a fabric to be flame retardant. An LOI of at least about 30 would be still more preferred for a fabric to be flame resistant.

The thermoplastic polymer of the core can be comprised of, for example, but not limited to, polyester polymer, poly(ethylene terephthalate), polyamide polymer or copolymers thereof. It is expected that in view of the flame retardant characteristics of the fully aromatic sheath polymers, the core polymer could be comprised of a non-flame retardant polymer, such as polyethylene, polypropylene and the like.

The cross-section of the bicomponent fiber comprises a sheath-core arrangement, wherein the flame retardant, fully aromatic thermoplastic polymer is formed into a sheath to encapsulate and shield the core from flame propagation. A concentric sheath-core arrangement with adequate sheath thickness will protect the core. A sheath comprising at least about 10% of the cross-sectional area of the bicomponent fiber has been demonstrated to be effective in retarding flame propagation. Preferably the sheath component comprises at least about 20% of the cross-sectional area of the bicomponent fiber. The cross-sectional area of the sheath component can be varied from about 10% to about 80% and above, if desirable. However, increasing percentage cross-sections of the flame retardant sheath polymer reduces the financial benefit of utilizing a bicomponent fiber. An eccentric sheath-core arrangement would also protect the core provided it had adequate sheath thickness at the thinnest part of the wall.

The flame retardant fabric of this invention can be used in woven and nonwoven products. These products can be made from continuous or discontinuous (or staple) fibers. The bicomponent fibers of this invention can be made from conventional bicomponent spinning techniques including melt spinning, spunbonding and meltblowing processes.

Test Methods

The following test methods were employed to determine various reported characteristics and properties. ASTM refers to the American Society for Testing and Materials.

Fiber Size is a measure of the effective diameter of a fiber. It is measure via optical microscopy and is reported in micrometers.

Basis Weight is a measure of mass per unit area of a fabric or sheet and was determined by ASTM D-3776, which is hereby incorporated by reference, and is reported in $g/m^2$.

Limited Oxygen Index (LOI) is the minimum concentration of oxygen in a mixture of oxygen and nitrogen flowing upward in a test column that will just support candle-like burning. Since the oxygen content of the earth's atmosphere is about 21%, materials with LOI's of approximately 26 and above should not continue to burn after the flame source is removed. LOI's were measured according to ASTM D-2863, which is hereby incorporated by reference and is reported in percent.

Open-Flame Resistance Fabric Test is a measure of a fabric's propensity to resist burning in an open flame. The test was conducted in accordance with Technical Bulletin 117, "Requirements, Test Procedure and Apparatus of testing the Flame and Smolder Resistance of Upholstered Furniture", Part 1, Section 2 from the State of California, Department of Consumer Affairs, Bureau of Home Furnishings and Thermal Insulation (draft version 2/2002), and which is hereby incorporated by reference. This test result is based on a pass/fail analysis. A fabric is deemed to fail the test if there is any penetration of the flame which creates a void through the thickness of the fiber test specimen. In addition, the loss of fabric was reported by calculating the difference in weight of the fabric both before and after the test and is reported in percent. The percent fabric weight loss indicates how much of the fabric was consumed in the test and therefore related to the flammability of the fabric. Modifications to the above test method include using a test specimen of 7×7 inches$^2$ instead of 12×12 inches$^2$ and a cotton sheeting (in accordance with Technical Bulletin 117, Annex E) with layered loose fibers on top. A metal screen was used as a support. No preconditioning of the test specimen prior to testing.

EXAMPLES

Examples 1 and 2

Unbonded sheets were made with spunbond bicomponent fibers comprising an 8000-series Zenite® LCP polymer sheath component and a flame retardant (FR) poly(ethylene terephthalate) polymer core component. The 8000-series Zenite® polymer is a fully aromatic liquid crystalline polyester as described in Example 6 of U.S. Pat. No. 5,525,700 with an LOI of >40 and a melting point (Tm) of 265° C. and was obtained from DuPont. The FR poly(ethylene terephthalate) polymer is a copolymer of poly(ethylene terephthalate) containing 0.5 weight percent phosphorus with an LOI of 39 and was obtained from Santai Company of China.

The LCP polymer as well as the FR poly(ethylene terephthalate) polymer were dried in separate through-air dryers at an air temperature of 120° C., to a polymer moisture content of less than 50 ppm. The LCP polymer was heated to 305° C. and the FR poly(ethylene terephthalate) polymer was heated to 290° C., in separate extruders. The two polymers were separately extruded and metered to a spin-pack assembly, where the two melt streams were separately filtered and then combined through a stack of distribution plates to provide multiple rows of concentric sheath-core fiber cross-sections.

The spin-pack assembly consisted a total of 1008 round capillary openings (14 rows of 72 capillaries in each row). The width of the spin-pack in machine direction was 11.3 cm, and in cross-direction was 50.4 cm. Each of the polymer capillaries had a diameter of 0.35 mm and length of 1.40 mm.

The spin-pack assembly was heated to 305° C. The polymers were spun through each capillary at a polymer throughput rate of 0.5 g/hole/min to produce a bundle of fibers. The bundle of fibers was cooled in a naturally entrained quench extending over a length of 38 cm. The attenuating force was provided to the bundle of fibers by a rectangular slot jet. The distance between the spin-pack to the entrance to the jet was 38 cm. Fiber samples with different Zenite® 8000:FR poly(ethylene terephthalate) ratios were made and are listed in Table 1.

The fibers exiting the jet were randomly laid onto a collection screen to form an unbonded sheet. Vacuum was applied underneath the collection screen to help pin the fibers. The collection screen speed was adjusted to yield a nonwoven sheet of approximately 140 g/m$^2$ basis weight.

Both unbonded sheets passed the open-flame resistance fabric test. Percentage fabric weight loss of the sheets was calculated and reported in Table 1.

Even with very low levels of % sheath of LCP polymer in the fiber, the fabrics still passed the open-flame resistance fabric test.

Comparative Example A

A spunbond sheet was made with spunbond monocomponent fibers comprising the flame retardant (FR) poly (ethylene terephthalate) polymer from Examples 1 and 2. These fibers were made in a similar manner to the bicomponent fibers of Examples 1 and 2 except the same polymer was used for the sheath and the core components thus producing monocomponent fibers. Also, these fibers were bonded after spinning in a conventional spunbond process to prepare a bonded sheet as compared with Examples 1 and 2 in which the fibers were not bonded after spinning.

The FR poly(ethylene terephthalate) polymer was dried in a through-air drier at an air temperature of 120° C., to a polymer moisture content of less than 50 ppm. The polymer was heated to 295° C. in an extruder. The polymer stream was extruded and metered to a spin-pack assembly, where the melt stream was filtered and then fed through a stack of distribution plates to provide multiple rows of fibers.

The spin-pack assembly consisted of a total of 1008 round capillary openings (14 rows of 72 capillaries in each row). The width of the spin-pack in machine direction was 11.3 cm, and in cross-direction was 50.4 cm. Each of the polymer capillaries had a diameter of 0.35 mm and length of 1.40 mm.

The spin-pack assembly was heated to 295° C. The polymers were spun through each capillary at a polymer throughput rate of 0.6 g/hole/min. The bundle of fibers was cooled in a cross-flow quench extending over a length of 64 cm. The attenuating force was provided to the bundle of fibers by a rectangular slot jet. The distance between the spin-pack to the entrance to the jet was 64 cm.

The fibers exiting the jet were randomly laid onto a collection screen to form an unbonded sheet. Vacuum was applied underneath the collection screen to help pin the fibers. The fibers were then thermally bonded between a set of embosser roll and anvil roll. The bonding conditions were 135° C. roll temperature and 23 N/m nip pressure. The collection screen speed was adjusted to yield a nonwoven sheet of approximately 140 g/m$^2$ basis weight.

The thermally bonded sheet was formed into rolls onto a winder.

Even though the fiber polymer had an LOI of at least 26, the bonded sheet failed the open-flame resistance fabric test. This could be due, in part, to the lack of fully aromatic character of the polymer. Sheets of Examples 1 and 2 did pass this test and have a fiber sheath polymer LOI of at least 26 and have a fiber sheath polymer that is fully aromatic. Percentage fabric weight loss of the sheet was measured and reported in Table 1. The percent fabric weight loss is greater for this sheet than the sheets of Examples 1 and 2.

Comparative Examples B and C

Unbonded sheets were made similarly to Examples 1 and 2 except for the fiber sheath and core polymers. The sheath polymer was poly(ethylene terephthalate) polymer with an LOI of 20 and was obtained from DuPont as Crystar® 4405 and the core polymer was the Zenite® 8000. Fiber samples with different Zenite® 8000:poly(ethylene terephthalate) ratios were made and are listed in Table 1.

Both unbonded sheets failed the open-flame resistance fabric test. Percentage fabric weight loss of the sheets was calculated and reported in Table 1.

Comparative Examples D and E

Unbonded sheets were made from Kevlar® and Nomex® fibers, both known flame retardant materials, obtained from DuPont. These fibers were obtained as yarns and chopped into staple fibers of 2.5 cm in length. The staple fibers were randomly laid onto a screen to make up unbonded sheets.

These unbonded sheets passed the open-flame resistance fabric test. Percentage fabric weight loss of the sheets was calculated and reported in Table 1.

TABLE 1

FIBER AND FABRIC PROPERTIES

| Example | Core Polymer | Sheath Polymer | Sheath LOI | % Fiber Sheath | Open Flame Test | % Fabric Weight Loss |
|---|---|---|---|---|---|---|
| 1 | FR PET | ZENITE 8000 | >40 | 10 | Pass | 0.9 |
| 2 | FR PET | ZENITE 8000 | >40 | 20 | Pass | 0.6 |
| A | FR PET | FR PET | 39 | 100 | Fail | 9.0 |
| B | ZENITE 8000 | PET | 20 | 37 | Fail | 11.7 |
| C | ZENITE 8000 | PET | 20 | 50 | Fail | 15.9 |
| D | KEVLAR ® | KEVLAR ® | 29 | 100 | Pass | 0.0 |
| E | NOMEX ® | NOMEX ® | 29 | 100 | Pass | 0.6 |

Where: FR PET = flame retardant poly(ethylene terephthalate)

In view of the result in Comparative Example A, it is clear that the flame retardant character of the fabrics of the invention is due to the presence of a fully aromatic thermoplastic polymer in the sheath of a sheath-core bicomponent fiber and not the flame retardant character of the polymer in the core. It is expected that non-flame retardant polymers could be used in the core in combination with the fully aromatic thermoplastic polymer in the sheath of the present invention and would obtain similar fabric performance as in Examples 1 and 2.

Examples 3 and 4

Unbonded sheets were made with melt spun bicomponent fibers comprising a 2000-series Zenite® LCP polymer sheath component and poly(ethylene terephthalate) polymer core component. The 2000-series Zenite® polymer is a fully aromatic liquid crystalline polyester with an LOI of >40, a melting point (Tm) of 235° C. and was obtained from DuPont. The poly(ethylene terephthalate) polymer has an LOI of 20 and was obtained from Dupont as Crystar® 4405.

The sheath polymer was dried at 105° C. for 60 hours and the core polymer was dried at 90° C. for 60 hours. The core and sheath polymers were separately extruded and metered to a spin-pack assembly having 10 spin capillaries. A stack of distribution plates combined the two polymers in a sheath-core configuration and fed the spinneret capillaries. The spin-pack assembly was heated to 280° C. The throughput was 1.1 g/hole/min and the spinning speed was 300 m/min. Fiber samples had different Zenite® 2000:poly(ethylene terephthalate) ratios and are listed in Table 2.

The filament bundle exiting the spinneret was cooled by a cooling air quench in a cross-flow quench zone, approximately 2 meters long. The filaments were then collected on cardboard cores on a winder. The filament bundle was then cut into staple fibers of 2.5 cm in length. The staple fibers were randomly laid onto a screen to make up unbonded sheets.

These sheets passed the open-flame resistance fabric test. Percentage fabric weight loss of the sheets was calculated and reported in Table 2.

Examples 5–7

Unbonded sheets were made similarly to Examples 3 and 4 except an 8000-series Zenite® LCP polymer sheath component was used instead of the 2000-series Zenite and various core polymers were used. The sheath polymer was heated to 290° C. instead of 280° C. In Example 5 the same poly(ethylene terephthalate) was used for the core polymer but in Examples 6 and 7 polypropylene from Himont as Profax® 6323 and polyamide from DuPont as Zytel® 158, respectively, were used in place of the poly(ethylene terephthalate). For Examples 5–7, the throughput was 1.1, 1.8, and 1.8 g/hole/min, respectively, and the spinning speed was 250, 300 and 200 m/min, respectively. Fiber samples had different Zenite® 8000:core polymer ratios and are listed in Table 2.

These sheets passed the open-flame resistance fabric test. Percentage fabric weight loss of the sheets was calculated and reported in Table 2.

Comparative Example F

An unbonded sheet was made with monocomponent fibers comprising poly(ethylene terephthalate) polymer from Examples 3 and 4. These fibers were made in a similar manner to the bicomponent fibers of Examples 3 and 4 except the same polymer was used for the sheath and the core components thus producing monocomponent fibers. The spinning speed was 400 m/min.

This sheet failed to open-flame resistance fabric test. Percentage fabric weight loss of the sheets was calculated and reported in Table 2.

TABLE 2

FIBER AND FABRIC PROPERTIES

| Example | Core Polymer | Sheath Polymer | Sheath LOI | % Fiber Sheath | Open Flame Test | % Fabric Weight Loss |
|---|---|---|---|---|---|---|
| 3 | PET | ZENITE 2000 | >40 | 30 | Pass | 1.2 |
| 4 | PET | ZENITE 2000 | >40 | 50 | Pass | 0.9 |
| 5 | PET | ZENITE 8000 | >40 | 20 | Pass | 0.6 |
| 6 | PP | ZENITE 8000 | >40 | 20 | Pass | 0.3 |
| 7 | PA | ZENITE 8000 | >40 | 50 | Pass | 0.6 |
| F | PET | PET | 25 | 100 | Fail | 29.0 |

Where: PET = poly(ethylene terephthalate)
PP = polypropylene
PA = polyamide

In view of the result in Comparative Example F, it is clear that the flame retardant character of the fabrics of the invention is due to the presence of a fully aromatic thermoplastic polymer in the sheath of a sheath-core bicomponent fiber.

In view of the demonstrated efficacies of the fibers and fabrics of the present invention to retard flame propagation, these materials will find use in fabric-containing articles which can benefit from flame retardance, for example in bedding materials such as mattresses, pillows, blankets, comforters or quilts and sleepwear or in protective garments, such as gloves, boots or boot covers, lab coats, jump-suits, etc.

What is claimed is:

1. A flame retardant fabric comprising bicomponent fibers having a sheath and a core wherein the sheath comprises a liquid crystalline polyester polymer with an LOI of at least 26, having a melting point (Tm) between about 200° C. and about 265° C., and the core comprises poly(ethylene terephthalate).

2. The flame retardant fabric of claim 1 wherein the bicomponent fiber sheath comprises a liquid crystalline polyester polymer with an LOI of at least 28.

3. The flame retardant fabric of claim 2 wherein the bicomponent fiber sheath comprises a liquid crystalline polyester polymer with an LOI of at least 30.

4. The flame retardant fabric of claim 1 wherein the bicomponent fiber sheath-core comprises a concentric sheath-core arrangement.

5. The flame retardant fabric of claim 1 wherein the bicomponent fiber sheath comprises at least 10% of the cross-sectional area of the fiber.

6. The flame retardant fabric of claim 5 wherein the fiber sheath comprises at least 20% of the cross-sectional area of the fiber.

7. The flame retardant fabric of claim 1 wherein the bicomponent fiber is continuous or discontinuous.

8. The flame retardant fabric of claim 1 wherein the bicomponent fabric comprises a woven or a nonwoven material.

9. A flame retardant bicomponent fiber comprising a core of poly(ethylene terephthalate) and a sheath of a fully aromatic liquid crystalline polyester polymer having a melting point (Tm) as measured by differential scanning calorimetry between about 200° C. and about 265° C.

10. The flame retardant fiber of claim 9, wherein said sheath comprises at least 10% of the cross-sectional area of the fiber.

11. The flame retardant fiber of claim 10, wherein said sheath comprises between 10 and 80% of the cross-sectional area of the fiber.

12. A mattress comprising the flame retardant fabric of claim 1 or the flame retardant fiber of claim 9.

13. A pillow comprising the flame retardant fabric of claim 1 or the flame retardant fiber of claim 9.

14. A blanket or comforter comprising the flame retardant fabric of claim 1 or the flame retardant fiber of claim 9.

15. An article of protective clothing comprising the flame retardant fabric of claim 1 or the flame retardant fiber of claim 9.

16. An article of sleepwear comprising the flame retardant fabric of claim 1 or the flame retardant fiber of claim 9.

* * * * *